US007412946B1

(12) United States Patent
Pritchard

(10) Patent No.: US 7,412,946 B1
(45) Date of Patent: Aug. 19, 2008

(54) WATER TUBE BOILER

(76) Inventor: Edward Pritchard, 6 Cone Close, Ringwood, Melbourne (AU)

( * ) Notice: Subject to any disclaimer, the term of this patent is extended or adjusted under 35 U.S.C. 154(b) by 81 days.

(21) Appl. No.: 11/525,802

(22) Filed: Sep. 22, 2006

Related U.S. Application Data

(60) Provisional application No. 60/720,210, filed on Sep. 23, 2005.

(51) Int. Cl.
*F22B 17/04* (2006.01)

(52) U.S. Cl. ..... 122/235.19; 122/265; 122/235.11

(58) Field of Classification Search ..... 122/490, 122/235.15, 235.19, 332, 265, 268, 459, 122/235.21, 235.11
See application file for complete search history.

(56) References Cited

U.S. PATENT DOCUMENTS

| | | | | | |
|---|---|---|---|---|---|
| 65,042 | A | | 5/1867 | Babcock et al. | |
| 309,282 | A | | 12/1884 | Babbit | |
| 335,697 | A | * | 2/1886 | Hartley | 122/290 |
| 469,810 | A | | 3/1892 | Zell | |
| 768,178 | A | | 8/1904 | Hok | |
| 855,934 | A | * | 6/1907 | Carr | 122/291 |
| 1,080,613 | A | * | 12/1913 | Wells | 122/265 |
| 1,132,036 | A | * | 3/1915 | Rosenthal | 122/265 |
| 1,184,977 | A | * | 5/1916 | Meier | 122/265 |
| 1,304,499 | A | * | 5/1919 | Meier | 122/235.17 |
| 1,343,824 | A | | 6/1920 | Horichi | |
| 1,411,327 | A | | 4/1922 | Duffy | |
| 1,468,666 | A | | 9/1923 | Lacey | |
| 1,917,533 | A | * | 7/1933 | Lucke | 122/268 |
| 2,064,098 | A | * | 12/1936 | Wood | 122/235.15 |
| RE21,772 | E | * | 4/1941 | Murray et al. | 122/235.15 |
| 3,696,794 | A | * | 10/1972 | Kearns | 122/235.11 |

* cited by examiner

*Primary Examiner*—Gregory A Wilson
(74) *Attorney, Agent, or Firm*—Donn K. Harms

(57) ABSTRACT

A steam generator for generation of steam in a water tube boiler having first and second upright headers in sealed communication with lower and upper inclining banks of tubes communicating therebetween. An end portion of the tubes in the upper bank, changes to a declining angle toward its communication with the upright header. The declining angle provides for increased separation of steam from hot water in the tubes.

20 Claims, 3 Drawing Sheets

WATER TUBE BOILER

This application claims the benefit of U.S. Provisional Patent Application No. 60/720,210, filed Sep. 23, 2005.

BACKGROUND OF THE INVENTION

1. Field of the Invention

The invention disclosed and described herein relates to steam generators. More particularly the apparatus and method of employment herein disclosed relates to an improved design for a water tube boiler and steam generator which provides for improved separation of steam from residual water and enhanced protection from overheating of water tubes. The unique inclined design with curved end portions can be employed in any number of fields using steam including driving steam engines, for process steam, for steam heating, for hospital sterilizers, for most commercial power plants, for nuclear generators using steam boilers, or in any application where steam is employed.

2. Prior Art

Water-tube style boilers for steam generation have been in use for decades and generally consist of natural-circulation style and submerged style water tube boilers. Water tube boilers were developed to satisfy the demand for large quantities of steam at pressures and temperatures far exceeding those possible with fire-tube boilers.

Water tube boilers have a low risk of disastrous explosion compared to fire box boilers or fire tube boilers, and they are space saving. They also provide for rapid steam raising and ease of transportation. However, water tube boilers have required that supply water should be substantially pure and specially treated to protect the steam tubes and may require special maintenance procedures for this reason.

Because of their safety and large production capacity for steam, water tube boilers are employed in products from steam engines to nuclear power plants and are considered an especially safe design for steam generation in a steam powered system. A wide variety of sizes and designs of water tube boilers are used in power stations, nuclear reactors, ships and factories. Well known designs such as those by Babcock and Wilcox have been in use for decades and those skilled in the art will understand the positioning and employment of the included water tube device herein, in proper communication with a heat source, for use in all such boilers.

Heating the water tubes of a water tube boiler or steam generator requires that fuel is burned inside a furnace, creating hot gas. The hot gases are communicated to the water tubes in various ways known in the art to heat up water in the steam-generating tubes.

Submerged water-tube boilers generally employ a means to heat water or fluid in the steam generator. The heat from fossil fuels, nuclear power, natural gas, or other sources, is communicated to a lower bank of inclined tubes through a first substantially upright header. The first or lower bank of tubes is inclined to communicate steam upwards through a plurality of the vertical headers. In such submerged boilers, the lower bank of tubes is substantially submerged in the heated water being communicated from the first upright header. Each of the lower bank of tubes communicates at an inclined end with a second substantially vertical header wherein steam rises in the second header and water will return to the reservoir below feeding the first header.

An upper bank of tubes communicating with the second header above the water line, receives the steam communicated through the second header from the lower bank of tubes, and communicates that steam through the upper bank of tubes at an inclined angle from the second substantially vertical header back to the first header. A preferred inclining angle for the first and second bank of tubes is at an angle between 11 and 15 degrees with a current especially preferred mode being substantially 12 degrees.

Various patents such as U.S. Pat. No. 309,282, (Babbitt) describe such conventional submerged water-tube steam generators and all suffer from inadequate separation of remaining water from the steam which has been communicated to the upper bank of tubes. As such, there exists a need for an improved water-tube style boiler or steam generator which both dries and separates water from the steam. Such a device should also minimize the danger of overheating the water tubes which damages the apparatus and in doing so, results in an increased power rating for the steam generator device. Such a device should provide steam for turbines and the like which is substantially free of water droplets which can severely damage turbine blades.

SUMMARY OF THE INVENTION

The disclosed device and method of forming the device provide for an improved water-tube boiler or steam generator, which overcomes the above-noted deficiencies of prior art. The disclosed device is suited for use wherever water tube type steam generator devices are employed in combination with a properly communicated heat source to produce steam whether it be a liquid or gas communicating the heat from a heat source to the water tube boiler.

The device features water tubing which is divided into two sections or banks. A lower section features a plurality of tubes each of which angle upward from a first end, which is in sealed engagement with a first vertical header. Each of the plurality of tubes in the lower section is in sealed engagement at the upper end, with a second substantially vertical header. In one mode of employment, the device is in operative communication with a heat source in the form of hot gases from a furnace. In other modes of employment, the device may be employed with the entire lower tube section, submerged in water as a submerged water tube boiler.

In operation, heated water is communicated into an upright first header and thereafter into the inclined tubes of the lower section of tubes. Steam, and the hottest portions of water from the lower section of tubes reaching the axial passage of the second upright header, will naturally rise in the second header where it is thereafter communicated to a second bank of inclined tubes in sealed engagement between the axial cavities of the second header and first header.

The second bank of tubes is also angled upward from a lower end engagement with the second header to an upper sealed engagement of the opposite end of each tube, with the first header. Steam and/or water communicated from the lower tube section into the second header is thereon communicated into the tubes making up the second bank of inclined tubes where it will naturally rise toward the upper end of the first header.

Thus, the device features two banks of tubes, with all of the tubes of the lower bank or section angled upward from a respective starting end to respective termination ends at the second header. All of the plurality of tubes in the upper bank angle upward from starting end in sealed communication with the second header, to their termination in sealed engagement with the first header. The upper or second bank traverses the distance between the first and second headers in the opposite direction as those of the lower bank.

In the preferred embodiment of the device, at the upper end portion of each tube member of the upper bank of tubes, adjacent to their individual engagement points with the first header, every tube is curved to angle downward to its sealed engagement with the second header. Consequently, an upper end portion of each tube in the upper bank of tubes changes direction from an upward angle to a downward angle just adjacent to a sealed engagement point with the first header.

Currently, this change in the angle of the upper ends of the tubes making up the upper bank changes around the curve from the noted upward angle to a declining angle. A current preferred angle of the upward incline is substantially 12 degrees relative to the substantially perpendicular second header to a declining angle of between 20 and 30 degrees with approximately 25 degrees being the especially preferred angle at their juncture with the substantially perpendicular first header.

The change in direction resulting in a downward or declining approach of the upper end portions of the tubes making up the upper bank of tubes has been found to provide an excellent increase in the efficiency of the device in separating water from steam which is to be communicated from the upper end of the first header to the device requiring the steam. Steam in the pipes of the inclining tubes of the upper bank of tubes naturally rises toward the top of each inclining tube. Consequently, at the point at the upper end of each tube where the direction or angle of the tubes changes from an incline to a decline toward the second header, steam is separated and accelerated into the first header in an upward direction. The water portion of the mixture which is already on the lower half of each tube, continues down the declining slope of the tubes entering the first header. This bifurcation of steam and water achieves an extremely high degree of separation of steam from water not heretofore provided by the simple horizontal or inclining tubes of prior art.

It is therefore an object of the present invention to provide a water tube component for a water tube boiler which provides increased boiler efficiency and steam generation which can be employed in all types of water tube boilers using a heat source generating steam for power.

It is a further object of this invention to employ downward curved portions of substantially all upper tubes of the water tube component to achieve increased separation of steam communicated to a device requiring it, from water.

These together with other objects and advantages which become subsequently apparent reside in the details of the construction and operation of the invention as more fully hereinafter described and claimed, reference being had to the accompanying drawings forming a part thereof, wherein like numerals refer to like parts throughout.

With respect to the above description, before explaining at least one preferred embodiment of the invention in detail, it is to be understood that the invention is not limited in its application to the details of construction and to the arrangement of the components or steps set forth in the following description or illustrated in the drawings. The various apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis for designing of other devices, methods and systems for carrying out the several purposes of the present buoyancy engine. It is important, therefore, that the objects and claims be regarded as including such equivalent construction and methodology insofar as they do not depart from the spirit and scope of the present invention.

Further objectives of this invention will be brought out in the following part of the specification wherein detailed description is for the purpose of fully disclosing the invention without placing limitations thereon.

BRIEF DESCRIPTION OF DRAWING FIGURES

DETAILED DESCRIPTION OF PREFERRED EMBODIMENTS OF THE DISCLOSED DEVICE

Figure 1:
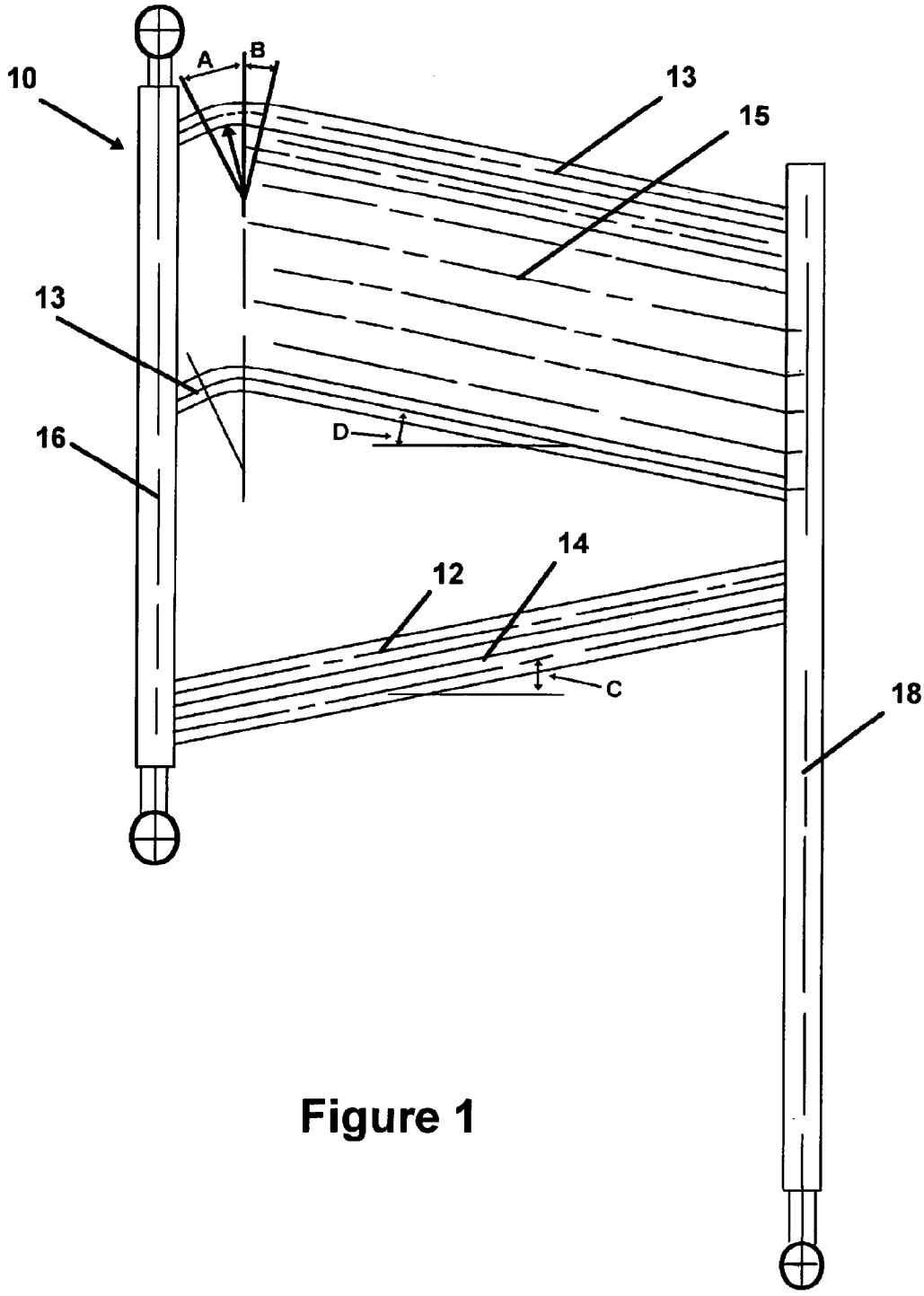
FIG. 1 depicts a view of the water tube apparatus herein described showing the improved configuration for use in as a segment of a water tube boiler or steam generator and adapted for engagement with a heat source to generate steam.
Figure 2:
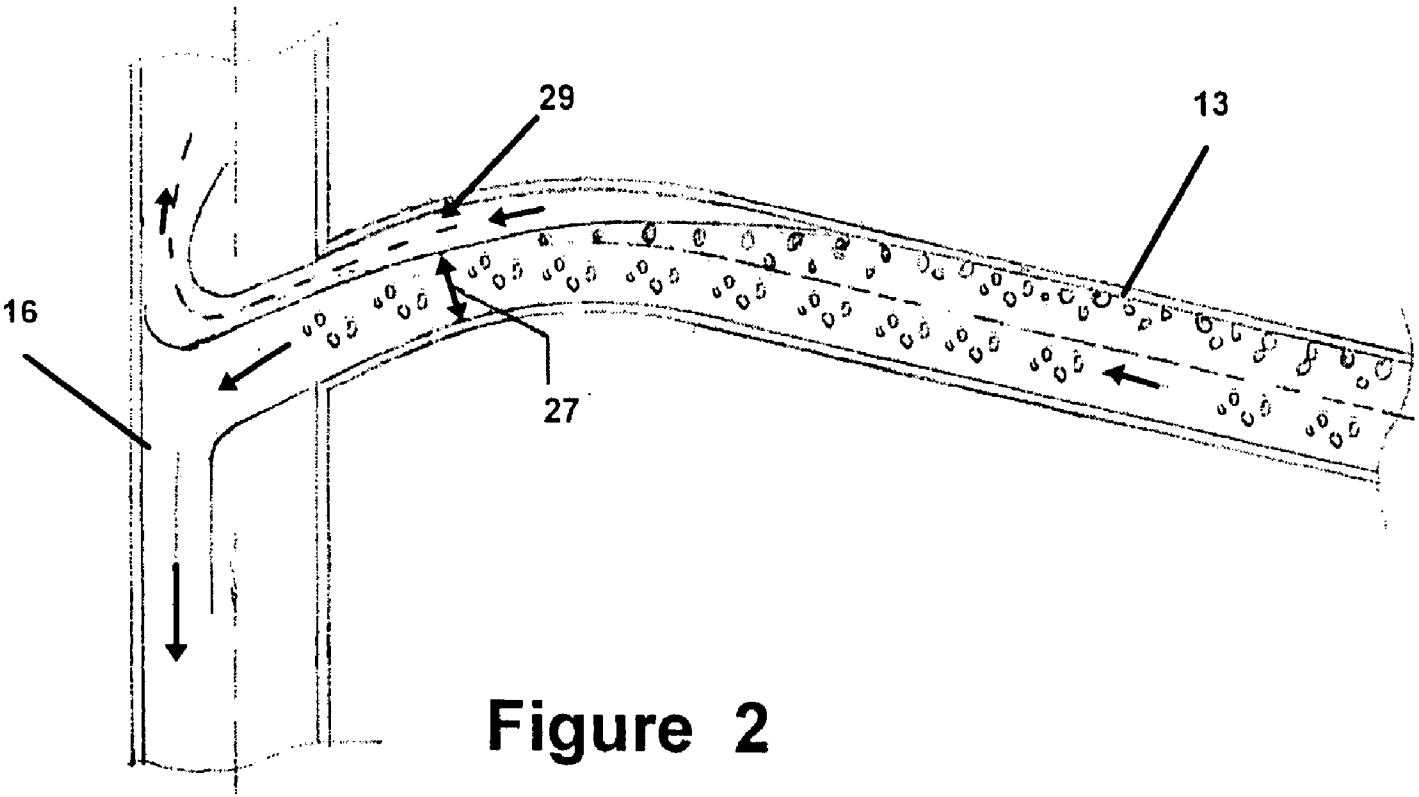
FIG. 2 depicts a view of the device of FIG. 1 employed as a submerged water tube boiler, showing angles of incline of both banks of tubes, and the especially preferred downward angles of the upper end portions of the second bank of tubes. Also shown is the submerged lower bank.
Figure 3:
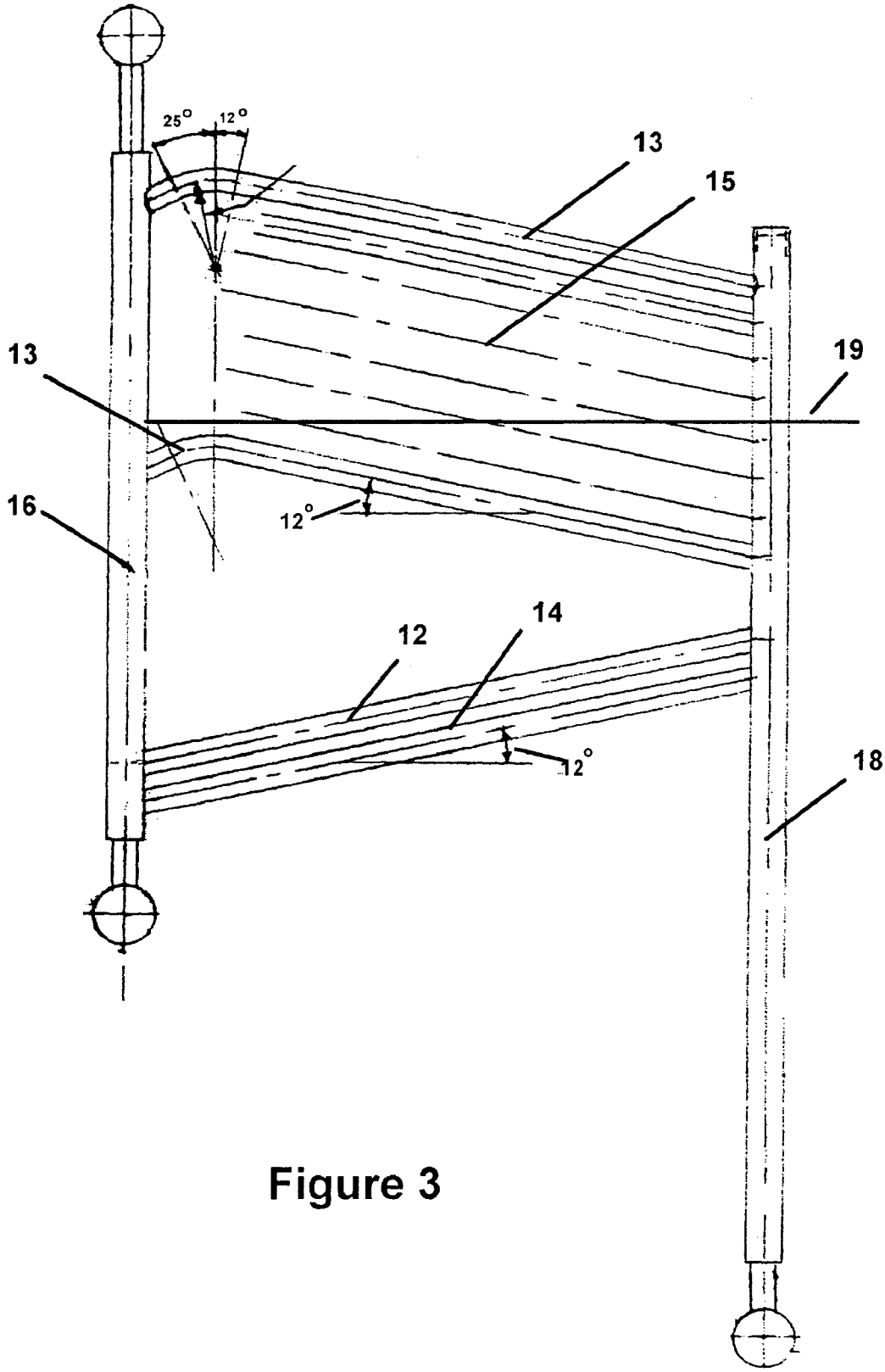
FIG. 3 depicts the improved separation of steam from water in the fluid flow when the upper end portion of the tubes of the upper bank communicates in a downward angle at their engagement with the first vertical header.

As depicted in FIGS. 1-3, the device 10 herein provides a steam generator or water-tube boiler which is adapted for operative engagement with a heat source such as a conventional furnace or other means for communication of heat to the device 10. Most such steam generators are formed of multiple segments of similar construction grouped to form a larger steam generator with the tubular components of the segments being substantially inline and parallel to each other. The device 10 with the aforementioned improved water and steam separation will provide significant improvement when used in any type of water tube boiler over the prior art. The device 10 adapted more mounting in operative communication with the chosen heat source to generate steam and features a plurality of tubes 12 and 13 for communicating steam and water through the device. The two inclining pluralities of tubes 12 and 13, are formed in two distinct banks.

A lower bank 14 features a plurality of tubes 12 which in the current mode are substantially parallel with each other, and having a fluid capacity sufficient for the intended purpose. Each of the tubes 12 of the lower bank 14 angle upward at an inclining angle "C" from a lower first end which is in sealed engagement with a first vertical header 16. Each of the plurality of tubes 12 in the lower bank 14 proceeds to a sealed engagement at an upper end, with a second, substantially vertical header 18. The first and second vertical headers 16 and 18 in the current preferred mode of the device 10 are substantially perpendicular to a level support surface, and parallel; however, it is anticipated that other angles for the vertical headers 16 and 18 to both the support surface, and each other, may be employed.

The device as shown in FIG. 2, in a particularly preferred mode may be installed as a steam generator in a submerged water tube type boiler configuration with the entire lower tube section submerged in water below the water level 19.

In operation for steam generation, heated water is communicated into the first header 16 and thereafter into the inclined tubes 12 of the lower bank 14 wherein steam and the hottest portion of water from the lower bank reaching the second upright 18 header will naturally rise in the second header 18. This steam and high temperature water is therein communicated to the second or upper bank 15 of inclined tubes 13 where it proceeds upward in the inclined tubes 13 from the second header 18 toward the first header 16.

The upper bank 15 of tubes 13 is angled upward at an angle of incline "D" from a first or lower end engagement with the second header 18 to a transition point (shown as line between "A" and "B") at a curve and then downward to a sealed engagement at a second end with the first header 16. Steam and/or water communicated from the lower tube bank 14 into the second header 18 is thereon communicated through the plurality of tubes 13 of the upper bank 15 where it will rise toward the second end engagement to the first header 16.

As noted, in an especially preferred mode of the device 10, which experimentation has shown to operate with improved efficiency, an end portion of each tube 13 of the upper bank 15, from a curve at a transition point adjacent to their respective individual engagement points with the first header 16, is angled downward in a declining angle "A" from a curved point along the transition point in each tube 13. This reversal in the angle at the upper ends of the tubes 13 of the upper bank 15 from the noted preferred incline to a declining angle or path in the end portion of each tube, has shown to provide unexpected results in steam and water separation and efficiency of the device 10. Currently the inclining angle of the tubes 13 yielding most favorable results when combined with the upright parallel first and second headers 16 and 18, is substantially 12 degrees relative to the substantially perpendicular second header 18. The declining angle of the end portion between the curved portion and the second end works very well at substantially 25 degrees heading toward the sealed engagement with the substantially perpendicular first header 16.

This improved efficiency in separating steam from water is yielded by a means for enhanced separation of water from steam being carried in the upper tubes 13 provided by the declining approach of the end portions of the tubes 13 at their sealed engagement to the upper portion of the first header 16. The improved separation of the steam and water in the tubes 13 provided by the declining end portion of the tube 13 is provided by the steam which rises toward the top of the tube 13 and the water on the bottom of the tubes 13 being accelerated during the decline. Steam in the tubes 13 at the sealed engagement to the header 16 already on the upper portion of the tube 13, is accelerated upward into the first header 16 as it reaches it. Water, which is already on the lower half of each tube 13 due to lower heat content and higher density, is also accelerated by the declining slope of the tubes 13 entering the first header 16. As the water is denser and being accelerated in a declining angle of velocity, it continues in the downward angle imparted by the end portions of the tubes 13 and into the first header 16.

The declining angle of the end portions of the upper bank of tubes 13 thereby results in a much hotter and drier steam being communicated into the upper portion of the first header 16 and onto the blades of a turbine, or for any other purpose requiring high pressure, dry, steam.

The method and components shown in the drawings and described in detail herein, disclose arrangements of elements of particular construction and configuration for illustrating preferred embodiments of structure of the present invention. It is to be understood, however, that elements of different construction and configuration, and using different steps and process procedures, and other arrangements thereof, other than those illustrated and described, may be employed for providing a steam generator or water tube boiler in accordance with the spirit of this invention.

As such, while the present invention has been described herein with reference to particular embodiments thereof, a latitude of modifications, various changes and substitutions are intended in the foregoing disclosure, and will be appreciated that in some instance some features of the invention could be employed without a corresponding use of other features, without departing from the scope of the invention as set forth in the following claims. All such changes, alternations and modifications as would occur to those skilled in the art are considered to be within the scope of this invention as broadly defined in the appended claims.

Further, the purpose of the foregoing abstract of the invention, is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting, as to the scope of the invention in any way.

What is claimed is:

1. A steam generator for generation of steam in a water tube boiler, comprising:

a first upright header having an interior axial pathway adapted for communication with a heated water supply;

a second upright header spaced a distance from said first header and defining a gap therebetween, said second upright header having an interior axial passageway;

a first plurality of tubes having interior passages, communicating in sealed engagement between said axial pathway and said axial passageway;

said first plurality of tubes forming a lower bank, each of said tubes of said lower bank having an angle of incline from a lower engagement point with said first upright header, to an upper engagement point with said second header;

a second plurality of tubes having axial conduits therethrough communicating in sealed engagement between said axial passageway and said axial pathway;

said second plurality of tubes forming an upper bank, each of said second plurality of tubes communicating at an inclining angle from a first end engaged to said second upright header to a transition point, adjacent to said first upright header;

an end portion of each of said tubes of said upper bank between said transition point and an engagement of said tubes with said first upright header; and said end portion having a generally declining angle from said transition point to said engagement with said first upright header.

2. The steam generator for a water tube boiler of claim 1 additionally comprising:

said declining angle providing means to accelerate said water toward a lower portion of said axial pathway and thereby separate said water from said steam communicated to said axial pathway.

3. The steam generator for a water tube boiler of claim 2 additionally comprising:

an upper end of said axial pathway adapted for communication of said steam to a steam driven mechanism.

4. The steam generator for a water tube boiler of claim 3 additionally comprising:

said declining angle being between 20 and 30 degrees.

5. The steam generator for a water tube boiler of claim 4 additionally comprising:

said angle of incline being angle being between 11 and 15 degrees; and said inclining angle being between 11 and 15 degrees.

6. The steam generator for a water tube boiler of claim 5 additionally comprising:

said angle of incline being angle being substantially 12 degrees; and said inclining angle being between substantially 12 degrees.

7. The steam generator for a water tube boiler of claim 6 additionally comprising:

said declining angle being between substantially 25 degrees.

8. The steam generator for a water tube boiler of claim 7 additionally comprising:

said first upright header and said second upright header being straight and being parallel to each other.

9. The steam generator for a water tube boiler of claim 8 additionally comprising:

Said first upright header and said second upright header and said first plurality of tubes and said second plurality of tubes, all located in a common plane.

10. The steam generator for a water tube boiler of claim 9 additionally comprising:

said steam generator formed of a plurality of segments of said steam generators, each of said segments located in adjacent planes; and said steam generators forming said segments in said adjacent planes having said first upright headers, said second upright headers, said first plurality of tubes and said second plurality of tubes, substantially aligned with those of adjacent said segments.

11. The steam generator for a water tube boiler of claim 7 additionally comprising:

Said first upright header and said second upright header being substantially perpendicular to an underlying support surface.

12. The steam generator for a water tube boiler of claim 6 additionally comprising:

said water tube boiler being a submerged water tube boiler adapted for submersion of substantially all of said lower bank of tubes.

13. The steam generator for a water tube boiler of claim 2 additionally comprising:

said declining angle being between 20 and 30 degrees.

14. The steam generator for a water tube boiler of claim 13 additionally comprising:

said angle of incline being angle being between 11 and 15 degrees; and said inclining angle being between 20 and 30 degrees.

15. The steam generator for a water tube boiler of claim 14 additionally comprising:

said angle of incline being angle being substantially 12 degrees; and said inclining angle being between substantially 12 degrees.

16. The steam generator for a water tube boiler of claim 15 additionally comprising:

said declining angle being between substantially 25 degrees.

17. The steam generator for a water tube boiler of claim 1 additionally comprising:

said declining angle being between 20 and 30 degrees.

18. The steam generator for a water tube boiler of claim 17 additionally comprising:

said angle of incline being angle being between 11 and 15 degrees; and said inclining angle being between 11 and 15 degrees.

19. The steam generator for a water tube boiler of claim 18 additionally comprising:

said angle of incline being angle being substantially 12 degrees; and said inclining angle being between substantially 12 degrees.

20. The steam generator for a water tube boiler of claim 19 additionally comprising:

said declining angle being between substantially 25 degrees.

* * * * *